United States Patent [19]

Saller

[11] Patent Number: 4,738,744

[45] Date of Patent: Apr. 19, 1988

[54] ONE-SIDED CORRUGATED BOARD MACHINE

[75] Inventor: Michael Saller, Moosbach, Fed. Rep. of Germany

[73] Assignee: BHS-Bayerische Berg-, Hutten- und Salzwerke Aktiengesellschaft, Fed. Rep. of Germany

[21] Appl. No.: 97,493

[22] Filed: Sep. 16, 1987

[30] Foreign Application Priority Data

Sep. 18, 1986 [DE] Fed. Rep. of Germany ..... 3631802

[51] Int. Cl.[4] ..... B31F 1/28

[52] U.S. Cl. ..... 156/472; 156/473; 425/369; 425/396

[58] Field of Search ..... 156/470, 471, 472, 473; 425/369, 396

[56] References Cited

U.S. PATENT DOCUMENTS 4,569,714 2/1986 Tokuno ..... 156/471
4,620,896 11/1986 Sueki et al. ..... 156/470
4,627,831 12/1986 Hirakawa et al. ..... 156/470
4,629,526 12/1986 Kanda ..... 156/472
4,631,109 12/1986 Hirakawa et al. ..... 156/472
4,643,706 2/1987 Pohl et al. ..... 156/472

FOREIGN PATENT DOCUMENTS 1538604 9/1968 France ..... 156/471

*Primary Examiner*—Jerome Massie
*Attorney, Agent, or Firm*—Silverman, Cass, Singer & Winburn, Ltd.

[57] ABSTRACT

One-sided corrugated board machine having at least two pair of corrugated rollers, a lower pair and an upper pair, wherein each pair of lower and upper corrugated rollers are supported on separate lateral, pivotable and fixable bearing brackets. A movable glue-applying device and clamping roller are provided such that they can be moved away from the pivoting path of the corrugated rollers. When it is desired to change the rollers of a single pair, one for another, the glue-applying device and the clamping roller are moved away from the pivoting path and the corrugated rollers are pivoted so as to change each pair of rollers one for another without having to rethread the paper tracks.

16 Claims, 1 Drawing Sheet

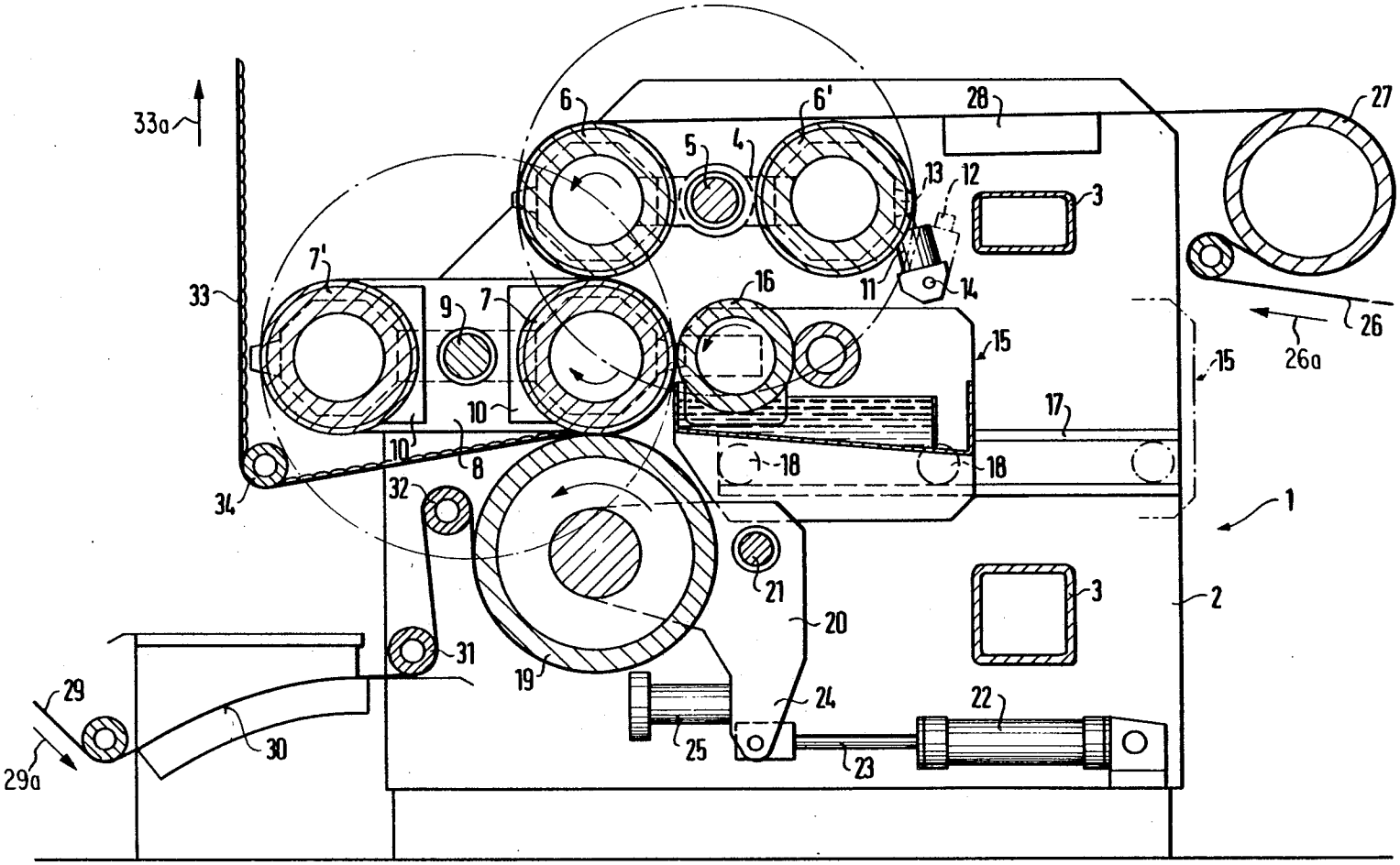
27
26
26a
1
15
2
3
3
17
28
12
14
15
18
22
13
11
23
6'
20
24
18
21
4
16
5
25
6
19
7
10
8
9
31
32
10
7'
30
33
34
33a
29
29a

ONE-SIDED CORRUGATED BOARD MACHINE

BACKGROUND OF THE INVENTION

This invention relates generally to corrugated board machines and more particularly to a one-sided corrugated board machine in which the paper does not need to be rethreaded each time the corrugated roller assemblies are changed.

One prior art one-sided corrugated board machine is disclosed in French patent FR No. 1,538,604. In this arrangement, two pairs of corrugated rollers are positioned on pivotable, lateral bearing brackets in the form of disks. However, the entering paper track for both the sheet to be corrugated and the cover sheet must be threaded anew each time the corrugated roller assembly is changed. Further, the feed lines to the vacuum system, the lubricant oil supply lines, and the steam feed lines must be detached and attached anew after changing the corrugated rollers.

SUMMARY OF THE INVENTION

The above and other disadvantages of the prior art one-sided corrugated board machines are overcome in accordance with the present invention by providing a one-sided corrugated board machine in which changing a specific corrugated roller assembly is simplified and the overall size of the one-sided corrugated board machine is reduced.

The assemblies of lower and upper pairs of corrugated rollers are supported on separate pivotable bearing brackets that are secured to a support part or wall. A glue applying device is positioned so that it can be moved out of the pivoting path of the corrugated rollers. After the glue applying device is moved aside, the corrugated rollers can be pivoted on the brackets to move the old rollers from a work position to a rest position and simultaneously move the new rollers from the rest position to the work position. Thus, the rollers are changed without needing to rethread the paper tracks. In addition, the pivot angle for the bearing bracket is minimized, so that the feed lines to the vacuum system, the lubricant oil lines, and the steam lines can remain in position while the corrugated rollers are being changed.

BRIEF DESCRIPTION OF THE DRAWING

The figure is a diagrammatic side view, partially in section of a one-sided corrugated board machine in accordance with the present invention.

DESCRIPTION OF THE PREFERRED EMBODIMENT

Referring to the FIGURE, a one-sided corrugated board machine is designated generally by the reference numeral 1. The machine 1 has lateral support parts or walls 2, which stand at a distance from one another, and which are connected in a distortion-free manner by spacing bars 3. A bearing bracket 4 is supported in a lateral pivotable and fixable manner on the support part or wall 2. A pivot drive is provided for the bearing bracket 4 (not shown). The bearing bracket 4 is constructed in an extended manner to support on its ends a pair of upper corrugated rollers 6 and 6' which can each be driven at the same distance from an axis 5.

A pair of lower corrugated rollers 7 and 7' are supported on a lateral and fixable extended bearing bracket 8, which can be pivoted around a pivot axis 9. In the work position, both the bearing bracket 8, and the bearing bracket 4, are in a horizontal position. Further, the pivot axes 5 and 9 of the bearing brackets 4 and 8, respectively, are displaced one from another so that the upper corrugated roller 6 can cooperate with the lower corrugated roller 7, as illustrated in the FIGURE.

Suction devices 10 are assigned to the lower corrugated rollers 7 and 7'. The suction devices 10 are provided to keep the corrugated material suctioned against the lower corrugated rollers 7 and 7' when the machine 1 is in the work position. Further, when the lower corrugated rollers 7 and 7' are in the horizontal work position, the bearing bracket 8 is fixed in place with a locking device (not shown).

A lifting cylinder 11 and a piston rod 12 cooperate with a nose unit 13 of the bearing bracket 4, to clamp one end of the bearing bracket 4 in position. Thus, in the work position, the corresponding clamping pressure of the upper corrugated roller 6 or 6' on the lower corrugated roller 7 or 7', respectively, can be set by adjusting the lifting action on the bearing bracket 4. The lifting cylinder 11 can be pivoted around an axis 14 to place the cylinder 11 in a rest position, as indicated by the dotted line. The lifting cylinder 11 can remain in this rest position when it is not in contact with the nose unit 13.

A glue-applying device 15 cooperates with the lower corrugated rollers 7 and 7'. In the work position, a glue-applying roller 16 transfers glue to a comb unit (not shown) of the corrugated material on the lower corrugated rollers 7 and 7'. The glue-applying device 15 can be displaced from the work position (which is illustrated by solid lines), to the rest position (indicated in dotted lines), by engaging rollers 18 in guide rails 17. In the rest position, the glue-applying roller 16 will not impede the pivoting of either of the bearing brackets 4 or 8.

A clamping roller 19 cooperates with the lower corrugated roller 7 or 7' when either of the respective rollers are in the work position. The clamping roller 19 is supported by a lateral bearing bracket 20, which can be pivoted around a rigid axis 21. The angularly constructed bearing bracket 20 can be pivoted by a lifting cylinder 22. In this case, a piston rod 23 is connected in an articulated manner with one end 24 of the bearing bracket 20. Adjustable stops or catches 25 are provided to determine the clamping pressure of the clamping roller 19.

In operation, the paper sheet 26, which is to be corrugated, runs in the direction of arrow **26*a* with an adjustable wrapping angle, over a preheating cylinder 27 and a humidifier 28 located essentially in a horizontal plane to the upper corrugated roller 6. The paper sheet 29, forming the cover sheet, runs in the direction of arrow 29*a*, over a curved heating surface 30 and reversal rollers 31, 32 to the clamping roller 19. The assembled one-sided corrugated board material 33 runs around a reversal roller 34 in the indicated direction of the arrow 33*a*, upwardly and away from the machine 1. Guide units (not shown) are provided to determine the progress of the paper sheet 26 to be corrugated, the cover sheet 29, and the emerging one-sided corrugated board 33**.

When it is desired to change the rollers that are in the work position from, for example, the corrugated rollers 6 and 7 to the corresponding rollers 6' and 7' respectively, the lifting cylinder 11 is unloaded and pivoted into a rest position. The glue-applying device 15 is released, and brought into a rest position. The clamping roller 19 is brought down, so that the bearing bracket 20 can be pivoted in a counterclockwise direction over the lifting cylinder 22. The roller assembly 7 and 7' is hereupon released, and pivoted by approximately 45° in the clockwise direction; the roller assembly 6 and 6' is then pivoted counterclockwise by approximately 135°; and the roller assembly 7 and 7' is pivoted into the work position and locked in place. Finally, the roller assembly 6 and 6' is pivoted by approximately an additional 45° counterclockwise for a total of approximately 180°, and the lifting cylinder 11 is brought into the work position again. The clamping roller 19 is returned to the work position by the lifting cylinder 22 and, with the pressure which is set by the adjustable stops or catches 25, set on the lower corrugated roller 7' which now occupies the work position. Finally, the glue-applying device 15 is again brought into its work position and locked. The position of the lower corrugated roller 7' must then be adjusted anew with the help of catches (not shown).

Modification and variations of the present invention are possible in light of the above teachings. A specific dimension or construction is not required so long as the assembled machine is able to function as herein described. It is therefore to be understood that within the scope of the appended claims, the invention may be practiced otherwise than as specifically described.

What is claimed and desired to be secured by Letters Patent of the United States is:

1. A one-sided corrugated board machine having at least two pairs of corrugated rollers each pair having a rotational axis; a glue-applying device; a movable clamping roller; guide units for the paper sheet to be corrugated and for the smooth cover sheet; as well as guide units for the emerging one-sided corrugated board, said corrugated board machine comprising:

an upper pair of corrugated rollers supported on lateral, pivotable, and fixable bearing means for pivoting said pair of rollers around the rotational axis to locate one of said pair of rollers from a work position to a rest position and the other of said pair of rollers from said rest position to said work position;

a lower pair of corrugated rollers supported on lateral, pivotable, and fixable bearing means for pivoting said pair of rollers around the rotational axis to locate one of said pair of rollers from a work position to a rest position and the other of said pair of rollers from said rest position to said work position to form a corrugating nip with the corrugating roller of said upper pair positioned in said work position; and movable glue-applying means for positioning said glue-applying device away from the pivoting path of said corrugated rollers for changing said rollers from one position to another without having to rethread the paper sheets in the guide units.

2. The corrugated board machine as defined in claim 1, wherein said bearing means are constructed in an extended manner and are positioned to be displaced horizontally in the longitudinal direction one above another to support said corrugated rollers on their ends.

3. The corrugated board machine as defined in claim 1, wherein rotational axes of said upper corrugated roller, said lower corrugated roller and said clamping roller lie in a vertical plane when said machine is in the work position.

4. The corrugated board machine as defined in claim 2, wherein rotational axes of said upper corrugated roller, said lower corrugated roller and said clamping roller lie in a vertical plane when said machine is in the work position.

5. The corrugated board machine as defined in claim 1, wherein said bearing means fix said lower corrugated rollers in a horizontal position, and further including that said bearing means for said upper corrugated rollers are connected with a pivot drive to clamp said upper corrugated roller into the work position against said lower corrugated roller.

6. The corrugated board machine as defined in claim 2, wherein said bearing means fix said lower corrugated rollers in a horizontal position, and further including that said bearing means for said upper corrugated rollers are connected with a pivot drive to clamp said upper corrugated roller into the work position against said lower corrugated roller.

7. The corrugated board machine as defined in claim 3, wherein said bearing means fix said lower corrugated rollers in a horizontal position, and further including that said bearing means for said upper corrugated rollers are connected with a pivot drive to clamp said upper corrugated roller into the work position against said lower corrugated roller.

8. The corrugated board machine as defined in claim 4, wherein said bearing means fix said lower corrugated rollers in a horizontal position, and further including that said bearing means for said upper corrugated rollers are connected with a pivot drive to clamp said upper corrugated roller into the work position against said lower corrugated roller.

9. The corrugated board machine as defined in claim 1, wherein the clamping roller is connected with a pivot drive and adjustable catches are provided for adjusting the clamping pressure.

10. The corrugated board machine as defined in claim 2, wherein the clamping roller is connected with a pivot drive and adjustable catches are provided for adjusting the clamping pressure.

11. The corrugated board machine as defined in claim 3, wherein the clamping roller is connected with a pivot drive and adjustable catches are provided for adjusting the clamping pressure.

12. The corrugated board machine as defined in claim 4, wherein the clamping roller is connected with a pivot drive and adjustable catches are provided for adjusting the clamping pressure.

13. The corrugated board machine as defined in claim 5, wherein the clamping roller is connected with a pivot drive and adjustable catches are provided for adjusting the clamping pressure.

14. The corrugated board machine as defined in claim 6, wherein the clamping roller is connected with a pivot drive and adjustable catches are provided for adjusting the clamping pressure.

15. The corrugated board machine as defined in claim 7, wherein the clamping roller is connected with a pivot drive and adjustable catches are provided for adjusting the clamping pressure.

16. The corrugated board machine as defined in claim 8, wherein the clamping roller is connected with a pivot drive and adjustable catches are provided for adjusting the clamping pressure.

* * * * *